US009085901B2

(12) United States Patent
Mueller

(10) Patent No.: US 9,085,901 B2
(45) **Date of Patent: *Jul. 21, 2015**

(54) PRE-ASSEMBLED INTERNAL SHEAR PANEL

(75) Inventor: Lee W. Mueller, Las Vegas, NV (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/385,333

(22) Filed: Feb. 13, 2012

(65) Prior Publication Data

US 2013/0025222 A1 Jan. 31, 2013

Related U.S. Application Data

(63) Continuation of application No. 09/603,727, filed on Jun. 23, 2000, now Pat. No. 8,112,968, which is a continuation of application No. 08/985,479, filed on Dec. 5, 1997, now abandoned, which is a continuation of application No. 08/572,519, filed on Dec. 14, 1995, now Pat. No. 5,706,626.

(51) Int. Cl.

| | |
|---|---|
| ***E02D 27/00*** | (2006.01) |
| ***E04C 2/38*** | (2006.01) |
| *E04H 9/02* | (2006.01) |

(52) U.S. Cl.

CPC .. *E04C 2/384* (2013.01); *E04H 9/02* (2013.01)

(58) Field of Classification Search

CPC ..... E04C 2/384; E04C 2/38; E04C 2/30; E04C 2/00; E04H 9/02; E04H 9/00

USPC ..... 52/800.1–800.18, 653.1, 167.3, 52/693–695, 656.2–656.8, 729.1–729.4, 52/741.3, 783.1, 790.1, 455–456, 52/481.1–481.2, 241, 167.4, 293.3

See application file for complete search history.

(56) References Cited

U.S. PATENT DOCUMENTS

| | | | |
|---|---|---|---|
| 140,526 | A | 7/1873 | Munson |
| 328,185 | A | 10/1885 | Butchee |

(Continued)

FOREIGN PATENT DOCUMENTS

| | | | |
|---|---|---|---|
| AU | 228186 | A | 1/1959 |
| AU | 549294 | B2 | 1/1986 |

(Continued)

OTHER PUBLICATIONS

Go-Panel Publisher: Go-Bolt, Inc., Deland, Florida, Published as early as 1999 (7 pages).

(Continued)

*Primary Examiner* — Mark Wendell

(74) *Attorney, Agent, or Firm* — James R. Cypher; Charles R. Cypher

(57) ABSTRACT

An internal shear panel for reducing the tendency of the upper portions of buildings to move relative to the foundation when lateral forces, such as those produced by winds and earthquakes, are applied to the walls. The shear panel is pre-assembled having two vertical posts and two diaphragm members interconnecting the posts. The panel also has an upper and a lower horizontal member that are connected to the posts and the diaphragm members. The lower horizontal member and the posts are configured to be attached via brackets to holdown bolts mounted in the foundation of a building and the upper horizontal member is configured to be attached to an upper plate of the wall. Hence, the shear panel can be installed by connecting the upper horizontal member to the upper portion of the wall and connecting the lower horizontal member to the holdown bolts in the foundation.

15 Claims, 9 Drawing Sheets

(56) References Cited

U.S. PATENT DOCUMENTS

| | | | |
|---|---|---|---|
| 390,732 | A | 10/1888 | Weston |
| 673,558 | A | 12/1900 | Kline |
| 1,353,998 | A | 9/1920 | Laughlin |
| 1,604,605 | A | 10/1926 | Purdy |
| 1,607,166 | A | 11/1926 | Mccall |
| 1,622,962 | A | 3/1927 | Michod |
| 1,689,642 | A | 10/1928 | Bappteyea |
| RE17,154 | E | 12/1928 | Purdy |
| 1,719,200 | A | 7/1929 | Schumacher |
| 1,742,045 | A | 12/1929 | Menes |
| 1,849,273 | A | 3/1932 | Broderick |
| 1,895,667 | A | 1/1933 | Junkers |
| 1,997,809 | A | 4/1935 | Cole |
| 2,010,971 | A | 8/1935 | Thomson |
| 2,020,988 | A | 11/1935 | Balletta |
| 2,053,226 | A | 9/1936 | Ruge |
| 2,063,010 | A | 12/1936 | Balduf |
| 2,076,728 | A | 4/1937 | Keller |
| 2,080,593 | A | 5/1937 | Albert |
| 2,089,023 | A | 8/1937 | Hahn |
| 2,124,519 | A | 7/1938 | Piersen |
| 2,137,767 | A | 11/1938 | Betcone |
| 2,154,520 | A | 4/1939 | Mackin |
| 2,160,225 | A | 5/1939 | Newman |
| 2,180,830 | A | 11/1939 | Le Tourneau |
| 2,191,804 | A | 2/1940 | O'Malley |
| 2,193,550 | A | 3/1940 | Coe, Jr. |
| 2,254,190 | A | 8/1941 | Ricken |
| 2,256,394 | A | 9/1941 | Lamel |
| 2,263,214 | A | 11/1941 | Larkin et al. |
| 2,271,584 | A | 2/1942 | Fellom |
| 2,278,331 | A | 3/1942 | Meyercord |
| 2,281,185 | A | 4/1942 | Forster |
| 2,445,491 | A | 7/1948 | Edgar |
| 2,457,964 | A | 1/1949 | Wyche |
| 2,497,887 | A | 2/1950 | Meler |
| 2,576,530 | A | 11/1951 | Medal |
| 2,633,610 | A | 4/1953 | Hervey |
| 2,666,238 | A | 1/1954 | Hagedorn |
| 2,725,608 | A | 12/1955 | Parslow |
| 2,742,114 | A | 4/1956 | Behlen |
| 2,743,980 | A | 5/1956 | Hobbs |
| 2,803,856 | A | 8/1957 | Kofabl et al. |
| 2,856,646 | A | 10/1958 | Latimer et al. |
| 3,010,547 | A | 11/1961 | Blythe |
| 3,037,593 | A | 6/1962 | Webster |
| 3,133,322 | A | 5/1964 | Douglas |
| 3,143,827 | A | 8/1964 | Showalter, Sr. |
| 3,160,245 | A | 12/1964 | Pavlecka |
| 3,172,509 | A | 3/1965 | Dugger |
| 3,206,903 | A | 9/1965 | Johnson |
| 3,300,926 | A | 1/1967 | Heirich |
| 3,304,675 | A | 2/1967 | Wood et al. |
| 3,310,917 | A | 3/1967 | Simon |
| 3,328,927 | A | 7/1967 | Kates |
| 3,360,892 | A | 1/1968 | Rosso |
| 3,452,501 | A | 7/1969 | Zimmer et al. |
| 3,474,582 | A | 10/1969 | Wah et al. |
| 3,568,388 | A | 3/1971 | Flachbarth et al. |
| 3,612,291 | A | 10/1971 | Skubic |
| 3,623,288 | A | 11/1971 | Horowitz |
| 3,633,327 | A | 1/1972 | Klingensmith et al. |
| 3,638,380 | A | 2/1972 | Perri |
| 3,657,849 | A | 4/1972 | Garton |
| 3,658,388 | A | 4/1972 | Hasegawa |
| 3,668,828 | A | 6/1972 | Nicholas et al. |
| 3,724,078 | A | 4/1973 | Carlin et al. |
| 3,744,197 | A | 7/1973 | Wetzel, Jr. |
| 3,748,799 | A | 7/1973 | Tough et al. |
| 3,775,920 | A | 12/1973 | Schneller |
| 3,820,295 | A | 6/1974 | Folley |
| 3,822,521 | A | 7/1974 | Lucas |
| 3,854,253 | A | 12/1974 | Slowbe |
| 3,871,153 | A | 3/1975 | Birum, Jr. |
| 3,875,719 | A | 4/1975 | Menge |
| 3,916,578 | A | 11/1975 | Forootan et al. |
| 4,016,697 | A | 4/1977 | Ericson |
| 4,016,698 | A | 4/1977 | Rogers |
| 4,037,281 | A | 7/1977 | Reynolds |
| 4,037,379 | A | 7/1977 | Ozanne |
| 4,037,381 | A | 7/1977 | Charles |
| 4,040,232 | A | 8/1977 | Snow et al. |
| 4,065,218 | A | 12/1977 | Biggane |
| 4,069,635 | A | 1/1978 | Gilb |
| 4,074,487 | A | 2/1978 | Daniels et al. |
| 4,078,352 | A | 3/1978 | Knowles |
| 4,114,333 | A | 9/1978 | Jones et al. |
| 4,122,647 | A | 10/1978 | Kovar |
| 4,130,970 | A | 12/1978 | Cable |
| 4,157,002 | A | 6/1979 | Adolph |
| 4,182,080 | A | 1/1980 | Naylor |
| 4,220,423 | A | 9/1980 | Sivachenko |
| 4,221,087 | A | 9/1980 | Lowe |
| 4,250,671 | A | 2/1981 | Hirsch et al. |
| 4,283,892 | A | 8/1981 | Brown |
| 4,292,782 | A | 10/1981 | Schaeffer |
| 4,295,299 | A | 10/1981 | Nelson |
| 4,295,318 | A | 10/1981 | Perlman |
| 4,301,628 | A | 11/1981 | Lowe |
| 4,309,853 | A | 1/1982 | Lowe |
| 4,321,776 | A | 3/1982 | Delight |
| 4,339,903 | A | 7/1982 | Menge |
| 4,366,659 | A | 1/1983 | Jensen |
| 4,370,843 | A | 2/1983 | Menge |
| 4,435,932 | A | 3/1984 | Seaburg et al. |
| 4,439,957 | A | 4/1984 | Raasakka et al. |
| 4,441,286 | A | 4/1984 | Skvaril |
| 4,441,289 | A | 4/1984 | Ikuo et al. |
| 4,471,591 | A | 9/1984 | Jamison |
| 4,498,264 | A | 2/1985 | Mccafferty et al. |
| 4,514,950 | A | 5/1985 | Goodson, Jr. |
| 4,522,000 | A | 6/1985 | Barari |
| 4,546,590 | A | 10/1985 | Finch et al. |
| 4,552,094 | A | 11/1985 | Johnson |
| 4,559,748 | A | 12/1985 | Ressel |
| 4,563,851 | A | 1/1986 | Long |
| 4,577,826 | A | 3/1986 | Bergstrom et al. |
| 4,603,531 | A | 8/1986 | Nash |
| 4,631,894 | A | 12/1986 | Jerila |
| 4,633,634 | A | 1/1987 | Nemmer et al. |
| 4,637,195 | A | 1/1987 | Davis |
| 4,648,216 | A | 3/1987 | Reaves et al. |
| 4,706,422 | A | 11/1987 | Ashton |
| 4,726,166 | A | 2/1988 | Derees |
| 4,736,566 | A | 4/1988 | Krotsch |
| 4,794,746 | A | 1/1989 | Ramer |
| 4,799,339 | A | 1/1989 | Kobori et al. |
| 4,863,189 | A | 9/1989 | Lindsay |
| 4,875,314 | A | 10/1989 | Boilen |
| 4,879,160 | A | 11/1989 | Knudson et al. |
| 4,910,929 | A | 3/1990 | Scholl |
| 4,918,900 | A | 4/1990 | Fee et al. |
| 4,922,667 | A | 5/1990 | Kobori et al. |
| 4,937,933 | A | 7/1990 | Dietrich |
| 4,937,993 | A | 7/1990 | Hitchins |
| 4,937,997 | A | 7/1990 | Thomas, Jr. et al. |
| 5,056,577 | A | 10/1991 | Delong et al. |
| 5,065,558 | A | 11/1991 | Boatsman |
| 5,070,661 | A | 12/1991 | Lo Guidici |
| 5,072,570 | A | 12/1991 | Johnson |
| 5,218,803 | A | 6/1993 | Wright |
| 5,271,197 | A | 12/1993 | Uno et al. |
| 5,279,088 | A | 1/1994 | Heydon |
| 5,333,426 | A | 8/1994 | Varoglu |
| 5,345,716 | A | 9/1994 | Caplan |
| 5,350,265 | A | 9/1994 | Kinner |
| 5,353,560 | A | 10/1994 | Heydon |
| 5,375,384 | A | 12/1994 | Wolfson |
| 5,388,358 | A | 2/1995 | Mazhar |
| 5,390,466 | A | 2/1995 | Johnson et al. |
| 5,417,026 | A | 5/1995 | Brumfield |
| 5,426,893 | A | 6/1995 | Hoffman |
| 5,457,927 | A | 10/1995 | Pellock et al. |
| 5,467,570 | A | 11/1995 | Leek |

(56) References Cited

U.S. PATENT DOCUMENTS

| | | | |
|---|---|---|---|
| 5,491,950 | A | 2/1996 | Obegi |
| 5,499,480 | A | 3/1996 | Bass |
| 5,505,031 | A | 4/1996 | Heydon |
| 5,524,406 | A | 6/1996 | Ragland |
| 5,546,723 | A | 8/1996 | Jones |
| 5,553,437 | A | 9/1996 | Navon |
| 5,579,615 | A | 12/1996 | Hoffman |
| 5,581,969 | A | 12/1996 | Kelleher |
| 5,617,693 | A | 4/1997 | Hefner |
| 5,619,837 | A | 4/1997 | Disanto |
| 5,628,495 | A | 5/1997 | Gandara |
| 5,640,824 | A | 6/1997 | Johnson et al. |
| 5,649,403 | A | 7/1997 | Haisch |
| 5,651,229 | A | 7/1997 | Wada et al. |
| 5,657,606 | A | 8/1997 | Ressel et al. |
| 5,664,388 | A | 9/1997 | Chapman et al. |
| 5,692,353 | A | 12/1997 | Bass et al. |
| 5,706,614 | A | 1/1998 | Wiley, Jr. et al. |
| 5,706,626 | A | 1/1998 | Mueller |
| 5,713,176 | A | 2/1998 | Hunt |
| 5,727,663 | A | 3/1998 | Taylor |
| 5,729,950 | A | 3/1998 | Hardy |
| 5,735,087 | A | 4/1998 | Olden |
| 5,761,873 | A | 6/1998 | Slater |
| 5,782,047 | A | 7/1998 | De Quesada |
| 5,782,054 | A | 7/1998 | Varoglu et al. |
| 5,788,396 | A | 8/1998 | Goto |
| 5,788,397 | A | 8/1998 | Goto |
| 5,807,014 | A | 9/1998 | Goto |
| 5,807,015 | A | 9/1998 | Goto |
| 5,823,701 | A | 10/1998 | Goto |
| 5,842,318 | A | 12/1998 | Bass et al. |
| 5,845,438 | A | 12/1998 | Haskell |
| 5,848,512 | A | 12/1998 | Conn |
| 5,862,639 | A | 1/1999 | Abou Rached et al. |
| 5,870,870 | A | 2/1999 | Utzman |
| 5,873,672 | A | 2/1999 | Goto |
| 5,904,025 | A | 5/1999 | Bass et al. |
| 5,906,451 | A | 5/1999 | Goto |
| D411,021 | S | 6/1999 | Chapman et al. |
| 5,921,054 | A | 7/1999 | Rudd |
| 5,924,815 | A | 7/1999 | Goto |
| 5,937,607 | A | 8/1999 | Li |
| 5,950,385 | A | 9/1999 | Herren |
| 5,979,130 | A | 11/1999 | Gregg et al. |
| 5,987,828 | A | 11/1999 | Hardy |
| 5,996,292 | A | 12/1999 | Hill et al. |
| 6,006,487 | A | 12/1999 | Leek |
| 6,018,917 | A | 2/2000 | Leek |
| 6,067,769 | A | 5/2000 | Hardy |
| 6,073,413 | A | 6/2000 | Tongiatama |
| 6,079,168 | A | 6/2000 | Shaver |
| 6,109,850 | A | 8/2000 | Commins |
| 6,148,583 | A | 11/2000 | Hardy |
| 6,158,184 | A | 12/2000 | Timmerman, Sr. et al. |
| 6,185,898 | B1 | 2/2001 | Pratt |
| 6,192,637 | B1 | 2/2001 | Boilen et al. |
| 6,205,725 | B1 | 3/2001 | Butler |
| 6,212,849 | B1 | 4/2001 | Pellock |
| 6,240,695 | B1 | 6/2001 | Karalic et al. |
| 6,244,004 | B1 | 6/2001 | Timmerman, Sr. et al. |
| 6,250,029 | B1 | 6/2001 | Jeffers et al. |
| 6,260,323 | B1 | 7/2001 | Hockey |
| 6,298,612 | B1 | 10/2001 | Adams |
| 6,298,617 | B1 | 10/2001 | De Quesada |
| 6,308,469 | B1 | 10/2001 | Leung |
| 6,327,831 | B1 | 12/2001 | Leek |
| 6,345,476 | B1 | 2/2002 | Hill |
| 6,385,942 | B1 | 5/2002 | Grossman et al. |
| 6,481,175 | B2 | 11/2002 | Potter et al. |
| 6,484,460 | B2 | 11/2002 | Vanhaitsma |
| 6,560,940 | B2 | 5/2003 | Mueller |
| 6,615,896 | B1 | 9/2003 | Andalia |
| 6,643,986 | B2 | 11/2003 | Commins et al. |
| 6,662,506 | B2 | 12/2003 | Fischer et al. |
| 6,668,508 | B2 | 12/2003 | Boone et al. |
| 6,877,285 | B2 | 4/2005 | Poma et al. |
| 7,073,298 | B1 | 7/2006 | Phan |
| 7,251,920 | B2 | 8/2007 | Timmerman, Sr. et al. |
| 8,112,968 | B1 * | 2/2012 | Mueller ..... 52/800.12 |
| 8,281,551 | B2 | 10/2012 | Leek |
| 2001/0002529 | A1 | 6/2001 | Commins et al. |
| 2002/0002806 | A1 | 1/2002 | Commins et al. |
| 2002/0020122 | A1 | 2/2002 | Mueller |
| 2003/0009964 | A1 | 1/2003 | Trarup et al. |
| 2004/0068947 | A1 | 4/2004 | Commins et al. |
| 2005/0126105 | A1 | 6/2005 | Leek et al. |
| 2005/0284073 | A1 | 12/2005 | Leek et al. |
| 2007/0062135 | A1 | 3/2007 | Mueller |

FOREIGN PATENT DOCUMENTS

| | | | |
|---|---|---|---|
| AU | 6487 | A | 6/1994 |
| AU | 2330695 | A | 1/1996 |
| AU | 715517 | B2 | 2/2000 |
| CA | 2196869 | A1 | 2/1996 |
| CH | 419526 | A | 8/1966 |
| DE | 259837 | C1 | 6/1912 |
| EP | 468949 | A1 | 1/1992 |
| FR | 2559408 | A1 | 8/1985 |
| FR | 2599408 | A1 | 12/1987 |
| GB | 2315288 | A | 1/1998 |
| JP | 49108213 | A | 10/1974 |
| JP | 54087616 | | 6/1979 |
| JP | 54152319 | A | 11/1979 |
| JP | 57106810 | U1 | 7/1982 |
| JP | 57143307 | U1 | 9/1982 |
| JP | 60085144 | A | 5/1985 |
| JP | 60122420 | U1 | 8/1985 |
| JP | 63039297 | A | 2/1988 |
| JP | 02049449 | | 4/1990 |
| JP | 03199550 | | 8/1991 |
| JP | 3208936 | A | 9/1991 |
| JP | 4083038 | A | 3/1992 |
| JP | 4098908 | A | 3/1992 |
| JP | 5044276 | A | 2/1993 |
| JP | 52019113 | U1 | 8/1993 |
| JP | 6002358 | A | 1/1994 |
| JP | 6322839 | A | 11/1994 |
| JP | 8159121 | A | 6/1996 |
| JP | 8284296 | A | 10/1996 |
| JP | 8296278 | A | 11/1996 |
| JP | 8302861 | A | 11/1996 |
| JP | 9256738 | A | 9/1997 |
| JP | 9273214 | A | 10/1997 |
| JP | 9279684 | A | 10/1997 |
| JP | 10140653 | A | 5/1998 |
| JP | 10184076 | A | 7/1998 |
| JP | 11229490 | | 8/1999 |
| JP | 2003293487 | | 10/2003 |
| NZ | 186060 | A | 11/1980 |
| NZ | 221612 | A | 3/1993 |
| WO | WO9602713 | A1 | 2/1996 |

OTHER PUBLICATIONS

Affidavit of Karen Colonias Regarding Testing of Third Party Products by Simpson Strong-Tie. (38 pgs), Sep. 11, 2007.

Utzman, Charles H. Provisional Patent Application Specification entitled "Shear Panel Joint." (25 pages), May 15, 1996.

James A. Adams, "Z-Wall", U.S. Appl. No. 60/003,181, filed Sep. 5, 1995 (Honolulu, Hawaii).

"Bulldog Timber Connectors. Develop Full Strength of Timber Members at Connections", Product brochure. Publication date unknown, received in the offices of James R. Cypher Oct. 24, 1997, Bulldog A/S, Oslo, Norway.

"Bulldog Steel Safety Timber Connectors." Product data. 1938. O. Theodorsen, C. E., Oslo, Norway.

"Hurri-Bolt Uplift Solutions. The Truss Tie-Down That Will Blow You Away. Engineering Manufacturing & Installation. SBCCI Report #9910," Product brochure. Publication date unknown; received in the offices of James R. Cypher Jul. 28, 1999. Hurri-Bolt Uplift Solutions, Inc. Tampa, Florida.

(56) References Cited

OTHER PUBLICATIONS

Evaluation Report ER-5467. Rayco Earthquake Mitigation Anchor System. Nov. 1, 1998. ICBO Evaluation Service, Inc., Whittier, California.
Evaluation Report PFC-5342. Hard Frame, Hardy Frame Heavy Duty, 18-inch Hard Braced Frame and Hardy Frame Screw. Sep. 1, 1999. ICBO Evaluation Service, Inc. Whittier, California.
MBR TDSystem "Typical Component Installation Details." Installation instructions and product data. Jun. 9, 1993, MBR Systems, South San Francisco, California.
Probolt, "Structural Tie Down System." Product data Sheet, installation instructions, and SBCCI Report No. 9916. 1999 Probolt, Orlando, Florida.
"Seismic Solutions Structural Tie Downs. Quake-Tie. The Superior Hold-Down Solution." Product brochure and data sheet. Jan. 1998.
"Simplified Structural Systems. Makers of the Hardy Frame." Product brochure. Dec. 1, 1999. Simplified Structural Systems, Ventural, California.
"Simpson Strong-Tie Connectors. Strong-Wall Shearwall." Product data. 1999. Simpson Strong-Tie Company, Inc., Pleasanton, California.
"Simpson Strong-Tie Connectors. Strong-Wall Shearwall." Installation guide. 2001. Simpson Strong-Tie Company, Inc., Pleasanton, California.
"MKP Monkey Paw Anchor Bolt Holders." "LBP/BP Bearing Plates." "RFB Retrofit Bolts." Wood Construction Connectors. Catalog-C-96. 1995. Simpson Strong-Tie Compnay, Inc., Pleasanton, California. p. 19.
Dunkley, D. "Prefab Shear Walls." The Journal of Light Construction. vol. 18, No. 3. Dec. 1999. pp. 46-53.
"Every Home Needs Z-Walls. The Strongest Shear Wall in the Smallest Space." Product brochure, 4 pages. Date unknown. KC Metal Products, Inc. San Jose, California.
"Zwall Shear Walls. Strength Where You Need It." Product data on-line. Retrieved from the internet Jun. 13, 2001 from URL: http://www.z-wall.com/photo15.htm, http://www.z-wall.com/photo7.htm, and http://www.z-wall.com/diag15.htm.
Tissell, J.R. & Rose, J.D. "Research Report 146. Roof Diaphragms for Manufactured Homes." American Plywood Association Technical Services Division. Tacoma, Washington, Sep. 1993.
Keith, E.L. "Research Report 153. Big Bin: Performance and Testing." American Plywood Association Technical Services Division. Tacoma, Washington. May 1990.
"Technical Note No. N370B. Stapled Sheet Metal Blocking for APA Panel Diaphragms." American Plywood Association. Tacoma, Washington. Nov. 1993.
"Industrial Use Guide. Materials Handling." APA The Engineered Wood Association. Tacoma, Washington. Jan. 1995.
"The Produce Protector. Making a Case for Plywood Harvest Bins." APA The Engineered Wood Association. Tacoma, Washington, May 1996.
A Test of Time. Plywood Harvest Bins Span Three Decades in Use. APA The Engineered Wood Association. Tacoma, Washington. Nov. 1996.
"APA Collapsible Bin Design and Fabrication." APA The Engineered Wood Association. Tacoma, Washington. Feb. 1997.
"Plywood for Tobacco Storage," Memorandum. APA The Engineered Wood Association. Tacoma, Washington. Date unknown. Received in the offices of James R. Cypher May 1997.
Breyer, D.E. Design of Wood Structures, 3rd Edition, Chapter 8 "Plywood and Other Structural-Use Panels" and cover and back (total 42 pgs), McGraw-Hill, Inc., 1993.
Breyer, D.E. Design of Wood Structures, 3rd Edition, Chapter 10 "Shearwalls" and pp. 497-532. McGraw-Hill, Inc., 1993.
Foliente, G.C., ed. Earthquake Performance and Safety of Timber Structures. Forest Products Society. Madison, Wisconson. 1997. (See in particular: Karalic, M. "Analysis of Performance of Floors and Shear Walls with the New Engineered Bracing Systems," pp. 115-124 and Commins, A. et al., "Effect of Hold-Downs and Stud-Frame Systems on the Cyclic Behavior of Wood Shear Walls," pp. 142-146).
"CS/CMST Colled Straps." & "SA/HAS Strap Connectors." Wood Construction Connectors. Catalog C-96. 1995. Simpson Strong-Tie Company, Inc., Pleasanton, California. p. 56.
"LTP/A34/A35 Framing Anchors." Wood Construction Connectors. Catalog C-96. 1995. Simpson Strong-Tie Company, Inc., Pleasanton, California. p. 58.
"HCST Hinge Connector Straps," "VB/VBP Knee Braces," "PSCL Panel Sheathing Clips," & "IS Insulation Supports." Wood Construction Connectors. Catalog C-97. 1996. Simpson Strong-Tie Company, Inc., Pleasanton, California. p. 53.
Schmid, B.L. "Apartment Bldgs Seismic Strengthening." Calculation sheet. Jul. 30, 1994 Balboa Island, California.
Utzman, Charles H. Provisional Patent Application Specification entitled "Shear Panel Joint." Filed May 9, 1997 (23 pgs).
"Typical CS Installation as a Floor-to-Floor Tie with Strap attached over plywood." Drawing sheet.
Alfred D. Commins and Robert C. Gregg, "Cyclic Performance of Tall-Narrow Shearwall Assemblies," Apr. 5, 1994, (12 pgs).
Affidavit of Karen Colonias Regarding Testing of Third Party Products by Simpson Strong-Tie.
Office Action dated Aug. 21, 2007, U.S. Appl. No. 10/705,662.
Office Action dated Jan. 23, 2009, U.S. Appl. No. 08/975,940.
Patty Christofferson, Tests of Narrow Plywood Shear-wall Panels Reveal Lack of Rigidity of Hold-down Anchorage, Structural Engineer's Association of Northern California Research Committee—Research Bulletin Board, Jan. 1994, B-1, BB94-1, Structural Engineers Association of Northern California, San Francisco, CA.
Cyclic Testing of Narrow Plywood Shear Walls, ATC R-1, 1995, Applied Technology Council, Redwood City, CA.
Lee W. Mueller, Corrugated Diaphragm Shear Panel, U.S. Appl. No. 60/215,290, filed Jun. 30, 2000.
Craig J. Miller, Light Gage Steel Infill Panels in Multistory Steel Frames, Engineering Journal, 1974, pp. 42-47, 2nd Quarter, American Institute of Steel Construction, Chicago, Illinois, United States.
Yasuhiko Takahashi, Toshikazu Takeda, Yasushi Takemoto, Masatoshi Takagi, Experimental Study on Thin Steel Shear Walls and Particular Steel Bracings under Alternative Horizontal Load, Reports of the Working Commissions, Symposium: Resistance and Ultimate Deformability of Structures Acted on by Well Defined Repeated Loads, 1973, pp. 185-190, vol. 13, International Association for Bridge and Structural Engineering, Lisboa, Spain.
Vincent Caccese, Mohamed Elgaaly, Ruobo Chen, Experimental Study of Thin Steel-Plate Shear Walls under Cyclic Load, Journal of Structural Engineering, Feb. 1993, pp. 573-587, vol. 119, No. 2, American Society of Civil Engineers, Reston, Virginia, United States.
Mohamed Elgaaly, Yinbo Liu, Analysis of Thin-Steel-Plate Shear Walls, Journal of Structural Engineering, Nov. 1997, pp. 1487-1496, vol. 119, No. 11, American Society of Civil Engineers, Reston, Virginia, United States.
Mohamed Elgaaly, Vincent Caccese, C. Du, Postbuckling Behavior of Steel-Plate Shear walls Under Cyclic Loads, Journal of Structural Engineering, Feb. 1993, vol. 119, No. 2, American Society of Civil Engineers, Reston, Virginia, United States.
Mohamed Elgaaly, Vincent Caccese, Steel Plate Shear Walls, Proceedings of the 1990 National Steel Construction Conference, copyright 2003, pp. 4-1-4-28, American Institute of Steel Construction, Chicago, Illinois, United States of America.
"Memorandum re Calculation of Wood Shrinkage for Proposed Quake-Tie Hold-down System Consideration." Jan. 20, 1997. Seismic Solutions, Glen Ellen, California.
Concise Drafting Services, Various letters, drawings and brochure from Roll Form Industries Pty, Ltd. Authors: Paul Tongiatama, e. La Monaca, J. House and Roll Form Industries.
Thallon, Rob. Graphic Guide to Frame Construction. Sep. 1991. (total 10 pgs), pp. 70, 77 79-82. The Taunton Press, Newtown, CT.
American Plywood Association. APA Homeowner's Guide to Earthquake Safeguards. Selected web pages (total 8 pgs), 1992.
Simpson Strong-Tie Co., Connectors for Earthquake Retrofit and New Construction. copyright 1991. Total 16 pages, Simpson Strong-Tie Company, Inc., USA.
Breyer, Donald E. Design of Wood Structures. 1993, Chapter 3, 3.1, 3.3, 3.4 and Chapter 10 (total 98 pgs).

(56) References Cited

OTHER PUBLICATIONS

Japanese Language Newspaper Article, 1 page.
Japanese Language Magazine Article, "Wide Focus", 2 pgs. (p. 20, 21).
Color Photocopies, "Wood Framed Residential Project in Kobe Japan Utilizing MFG. LWM Steel Shear Panels", 1996, 4 pgs.
Acceptance Criteria for Prefabricated Wood Shear Panels, ICBO Evaluation Service, Inc., Jul. 1997, USA.
John R. Tissell, Wood Structural Panel Shear Walls, May 1993, Report 154, APA Engineered Wood Association, USA.
The Hardy Frame Brochure, HFX Series: Sheer Wall Systems. Total 16 pgs, A Mitek Company.
ShearMax Panel Brochure, by Shear Transfer Systems, (8 pgs), Hesperia, CA.
LBN—Light Beam Inc., Steel Homes, 17 pgs, 1995.
ICBO Evaluation Service, Inc. Report: STS Prefabricated Lateral-Force Resisting (LFR) Panel System.6 pgs. Jul. 1, 1998.
Chen, W.F. Handbook of Structural Engineering, 1997, pp. 1-1 through 1-27, 2-1 through 2-7, 2-117 through 2-164, 3-1 through 3-11, 3-49, 3-50, 5-1 through 5-53, 7-49 through 7-53, 8-5, 8-6, 19-1 through 19-23, CRC Press LLC, Boca Raton, FL.
U.S. Appl. No. 60/043,835, filed Apr. 14, 1997, "Lateral Force Resisting System," Inventor: Timothy L. Timmerman (53 pgs).
"Trembler Spurs Builder to Create Anti-Quake Frame," Daily Press (Victorville, CA), p. A-4 (1 page), Apr. 26, 1999.
"P.T. Brace," Roll Form Industries Pty Ltd. (Acacia Ridge, Qld.), 2 pgs.
Simpson Strong-Tie Company, Inc. Catalogue, "Handbook of Structural Designs & Load Values," Strong-Tie Timber Connectors (2 pgs), Sep. 20, 1978.
Donald E. Breyer, "Design of Wood Structures," 3rd ed., McGraw-Hill Inc., Chapters 9, 11, 12.1 and 12.9, cover and title page (total 89 pgs), Dec. 20, 1993.
Paul Polikapo Tongiatama, Provisional Specification "PT Brace", (28 pgs), dated Jun. 28, 1994.
"Typical CS Installation as a Floor-to-Floor Tie with Strap attached over plywood," Drawing, drawing shows installation occurring at least as early as Jan. 1, 1995, 1 page, see accompanying statement.
"Affidavit of Karen Colonias Regarding Testing of Third Party Products by Simpson Strong-Tie," affidavit concerns earlier events, some of which took place at least as early as May, 1995, 38 pages, see accompanying statement.
Authors: Paul Tongiatama, E. La Monaca, J. House and Roll Form Industries, Pty. Ltd., "Various letters, drawings and brochure concerning activities by Concise Drafting Services and Roll Form Industries Pty, Ltd.", documents suggest activities took place as early as May 30, 1994, 11 pages, see accompanying statement.
Japanese Language Newspaper Article of Unknown Author, Title and Publication Name, believed publication date is Feb. 12, 1996, 1 page, see accompanying statement, publisher unknown.
Japanese Language Magazine Article of Unknown Author and Title, Wide Focus Magazine, at least as early as Mar. 1996, 2 pgs. - pp. 20, 21, see accompanying statement, publisher unknown.
Photocopies of pictures showing "Wood Framed Residential Project in Kobe Japan Utilizing Lee Mueller's Steel Shear Panels", building erected in 1996, 4 pgs., see accompanying statement.
The Hardy Frame—Brochure, it is believed this brochure was public in early 1997, see accompanying statement, 4 pgs, Hardy Frames, California, US.
ShearMax Panel Brochure, it is believed this brochure was public in early 1998, 8 pages, Shear Transfer Systems, Hesperia, California, US, see accompanying statement.
P.T. Brace—Brochure, this reference is similar to reference C53 the documents of which suggest activities took place as early as May 30, 1994, 2 pages, Roll Form Industries Pty Ltd., Acacia Ridge, Queensland, Australia, see accompanying statement.

* cited by examiner

PRE-ASSEMBLED INTERNAL SHEAR PANEL

This application is a continuation of copending application Ser. No. 09/603,727, filed on Jun. 23, 2000. Application Ser. No. 09/603,727 is a continuation of application Ser. No. 08/985,479, filed on Dec. 5, 1997, now abandoned. Application Ser. No. 08/985,479 is a continuation of application Ser. No. 08/572,519, filed on Dec. 14, 1995, now U.S. Pat. No. 5,706,126.

BACKGROUND OF THE INVENTION

1. Field of the Invention

The present invention relates to an apparatus for reducing the risk of damage to buildings as a result of lateral forces applied to the building and, in particular, concerns a pre-assembled internal shear panel that can be installed into a building wall to reduce the risk of the building wall becoming dislodged from the foundation as a result of lateral forces such as those generated in earthquakes and high winds.

2. Description of the Related Art

In typical building construction the walls are comprised of a frame that is anchored to the foundation and a covering that is installed onto the frame. Typically, the frame of a building has a number of vertically extending studs that are positioned between an upper and a lower plate. The lower plate is typically anchored to the foundation and the covering material, e.g., plywood, siding and the like, is then nailed to the studs.

One problem that occurs in buildings is that lateral forces applied in a direction parallel to, and in the plane of, the wall can cause the upper section of the wall to move relative to the lower plate which is anchored to the foundation. These forces often occur as a result of natural phenomenon such as high wins and earthquakes. It will be evident that too much movement of the upper sections of the wall relative to the anchored lower plate can result in damage to the frame of the wall which can further result in the wall collapsing.

To address this particular problem, buildings are often equipped with a lateral bracing system. One type of lateral bracing system is known as shear panels that are installed in the walls to stiffen the structure against racking or deformation in the plane the walls. For example, in the typical residential building, wherein the frames are primarily constructed of wood, plywood sheathing is attached to three or more of the studs, and to the upper and lower plate of the wall, to inhibit the movement of the upper portion of the wall in response to these lateral forces. Specifically, the end studs of the shear panel or posts are typically fastened to a heavier anchor bolt, known as a holdown bolt, at a position adjacent to the end posts by means of various hardware types known as holdowns. The plywood, which forms a vertical diaphragm, is attached to the upper plate and the lower plate of the wall, and also to the posts with specified boundary fasteners such that the shear force is transmitted through the diaphragm to end posts, the holdown device, and bolt. Hence, the tendency of the upper portion of the wall to move relative the lower portion of the wall as a result of the shear forces is reduced. Basically, the plywood diaphragm creates diagonal braces that inhibit movement of the upper portion of the wall relative to the lower portion.

These shear panels are typically built in the field during the construction of the building. It will be appreciated that constructing these structures in the field can be time consuming and can also result in construction errors that will affect the strength of the wall.

Further, these types of shear panels and, in particular, the plywood shear panels used in wooden framed buildings, must be comparatively large to withstand the significant amount of lateral forces that are generated in large earthquakes. For example, most building codes limit the story drift or lateral deformation to ¼" for an 8' wall height in all types of buildings. The ratio of the height of various shear panels to their width is also limited by the building code depending on the type of sheathing material used. To achieve this limitation on story drift in response to this applied lateral force, the shear panel must generally include a plywood diaphragm that is on the order of 2 to 4 feet in length. While on long walls there may be the space available between openings to position a 4-foot long or greater shear panel, in smaller buildings with smaller lengths of walls, there is often no room to construct shear panel of this size. Further, it will be appreciated that multiple story buildings are more susceptible to larger lateral forces often necessitating even larger lateral bracing structures. This exacerbates the problem of a limited amount of space in walls of smaller lengths.

Hence, there is a need for a shear panel which is easy to install and is comparatively small in size so that it can be readily installed in walls having shorter lengths. To this end, there is a need for a prefabricated shear panel that is capable of ready installation into and between the studs of walls wherein the shear panel is capable of minimizing the movement of the upper portion of the wall relative to the lower portion to within an acceptable amount.

SUMMARY OF THE INVENTION

The aforementioned needs are satisfied by the pre-assembled internal shear panel apparatus of the present invention which is comprised of two side members, or vertical posts that are spaced apart, and at least one diaphragm member that is positioned between, and connected to, the two side members. Further, there is an upper and lower member that is connected to the side members and the diaphragm members so as to form a rigid structure.

The lower member is positioned within a bracket member that is configured to be attached to a holdown bolt that is anchored in the foundation. There are two bracket members, one on each end, which are attached to one of the posts and both of the bracket members are also respectively connected to holdown bolts that are anchored in the foundation of the building.

The side, top and bottom members of the shear panel are all attached to form a preferably rectangular frame of which the upper member of the panel is connected to an upper plate of the wall. This results in a shear panel capable of opposing lateral forces in the plane of the wall so as to reduce movement of the upper plate of the wall with respect to the lower plate.

In one preferred embodiment, the posts are formed out of a plurality of light gauge steel members and there are two sheets of sheet steel forming a diaphragm that are attached to both of the posts substantially along the full length of the posts and to the top and bottom frame members, with one sheet on each side of the frame. Further, there is preferably at least one reinforcing member which interconnects the posts positioned between the upper and lower member and between the two sheets forming the diaphragm members. The reinforcing member stiffens the side members and reduces the tendency for the steel sheets to buckle when the shear panel is under load.

The shear panel of the preferred embodiment is attached at the bottom corners to holdown bolts which are anchored in the foundation of the building and the bottom member of the steel frame is fastened to the concrete foundation with a minimum of two anchor bolts or approved fasteners. The upper member of the shear panel of the preferred embodiment is connected to the upper plate of the frame of the wall so that lateral forces in the plane of the wall are transmitted to the sear panel. Because the later force is applied through the top plate there is an overturning effect on the panel that is resisted by the end posts, holdown assembly and anchor bolts. The horizontal shear force is resisted by the additional anchor bolts or fasteners in the bottom frame members. In one preferred embodiment, a gusset is used to attach the upper member of the shear panel to the upper plate of the frame of the wall. Further, in the preferred embodiment additional shear bolts are mounted through the lower member of the shear panel into the foundation of the building to reduce the likelihood that the shear panel will become dismounted at the bottom end from the foundation as a result of shear forces applied against the wall.

The shear panel of the preferred embodiment is preferably shipped to the job site substantially assembled. The installer simply has to attach the mounting brackets to the holdown bolts that are anchored in the foundation and then position the lower member of the shear panel in the brackets. Subsequently, the installer has to secure the lower member of the shear panel to the brackets, and, hence, to the concrete foundation with cast-in-place anchor bolts or other approved fasteners. Subsequently, the remainder of the shear panel can be attached to the lower member. Further, the upper member of the shear panel can then be attached to an upper portion, e.g., the upper plates, of the wall. Hence, installation of the shear panel of the preferred embodiment is simplified over constructing an appropriate shear panel in the field during the construction of the building.

In addition, the configuration and metal construction of the shear panel of the preferred embodiment results in a shear panel that is capable of withstanding greater amounts of shear forces than the shear panel structures of the prior art. This allows the shear panel of the preferred embodiment to be smaller in size, e.g., have a smaller width, which allows the shear panel to be installed along smaller wall sections without a decrease in the amount of protection against lateral forces. These and other objects and features of the present invention will become more fully apparent from the following description and appended claims taken in conjunction with the accompanying drawings.

DETAILED DESCRIPTION OF THE PREFERRED EMBODIMENT

Figure 1:
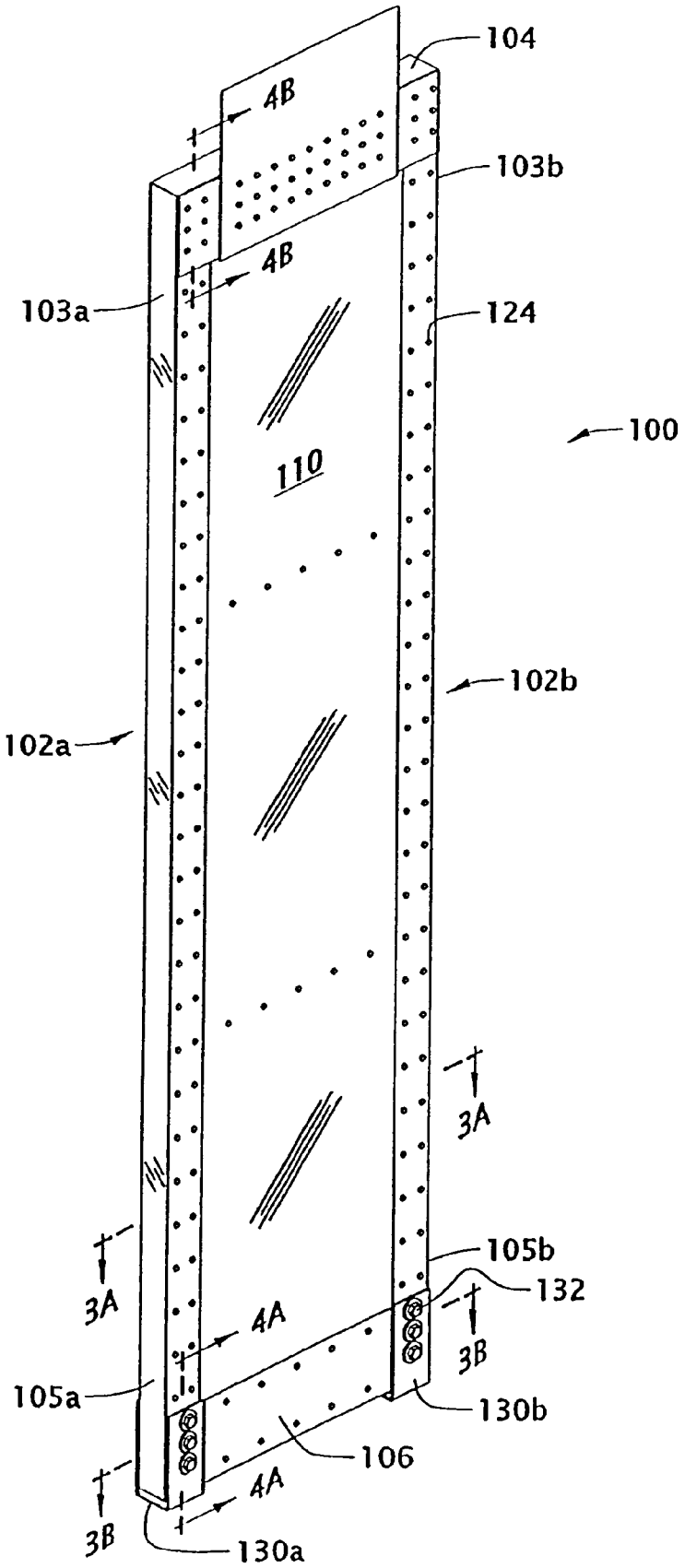
FIG. 1 is a perspective view of one preferred embodiment of a shear panel.

Reference will now be made to the drawings wherein like numerals refer to like parts throughout. FIG. 1 is a perspective view of a shear panel 100 of the preferred embodiment that is used to reduce the relative motion of an upper section of a wall relative to a bottom section of a wall in response to lateral forces that project in a direction along the length of the wall. The construction of the preferred embodiments of the shear panel 100 will initially be described in reference to FIGS. 1-4 and the installation and operation of the shear panel 100 of the preferred embodiments will be described in reference to FIGS. 5-7.

Referring initially to FIG. 1, a shear panel 100 of the preferred embodiment is shown. FIG. 1 illustrates he preferred configuration of the shear panel 100 in an assembled form as it is shipped to the building site. The shear panel 100 includes two vertical or side posts 102*a* and 102*b* that preferably extend the height of a wall (not shown). Typically, in most residential construction, wall heights are either 7'-8" tall or 10' tall. The vertical posts 102*a* and 102*b* are thus approximately either 7'-8" or 10" tall depending upon the application. It will be appreciated from the following description that walls having different heights may also be braced using the shear panel of the present invention. For example some gables and walls having a pitch at the top equivalent to the roof pitch of the structure may be even higher than 10'. The shear panel of the preferred embodiment can be installed in these application as well, necessitating the use of a 10' high panel.

The side posts 102*a* and 102*b* at their upper ends 103*a* and 103*b* respectively, are connected to a horizontal upper member 104. Similarly, the vertical posts 102*a* and 102*b* are connected at their respective lower ends 105*a* and 105*b* to a horizontal member 106. The interconnection between the posts 102*a* and 102*b* and the upper and lower members 104, 106 respectively is described in greater detail hereinbelow in reference to FIGS. 3A and 3B.

Further, at least one diaphragm member 110 which forms a brace member for the apparatus 100 extends between the vertical posts 102*a* and 102*b* substantially along the entire height of the vertical posts 102*a* and 102*b* and is also connected to the upper member 104 and the lower member 106. As will be described in greater detail hereinbelow, the diaphragm member serves to transmit a force in opposition to the force exerted on the upper member 104 to the lower member 106.

Figure 2A:
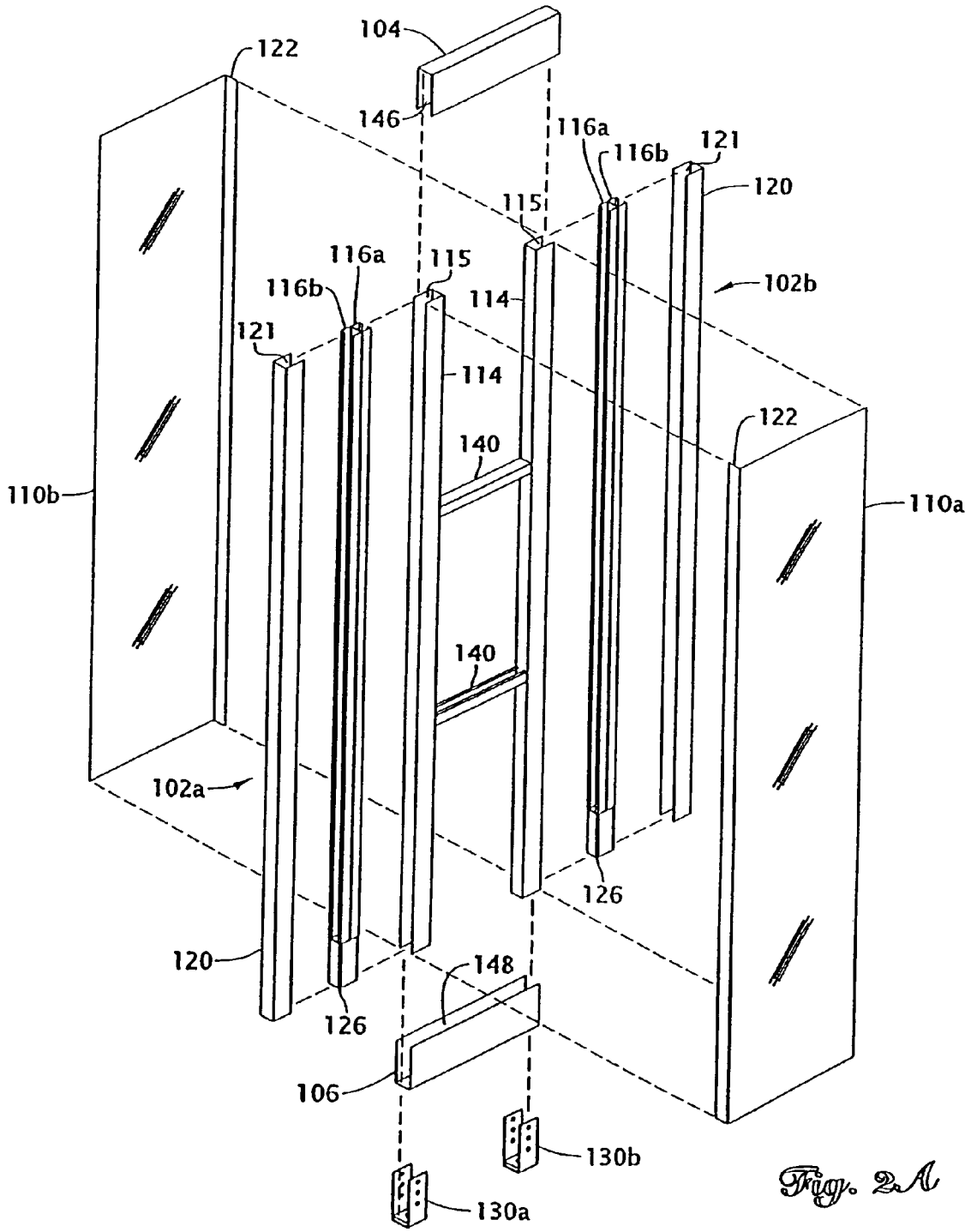
FIG. 2A is an exploded perspective assembly view of the shear panel shown in FIG. 1.

FIG. 2A illustrates the construction of the components of the shear panel 100 in greater detail. Specifically, the vertical post 102*a* in this embodiment is comprised of an inner retaining member 114 wherein two reinforcing members 116*a* and 116*b* are positioned inside of the inner retaining member 114. In the preferred embodiment, the inner retaining member 114 is comprised of a piece of U-channel where the opening to the U-channel faces outward and the two pieces of reinforcing member 116*a* and 116*b* are comprised of two pieces of Cee-channel that are configured to be positioned within the inner retaining member 114 in the manner shown in FIG. 3A.

Figure 3A:
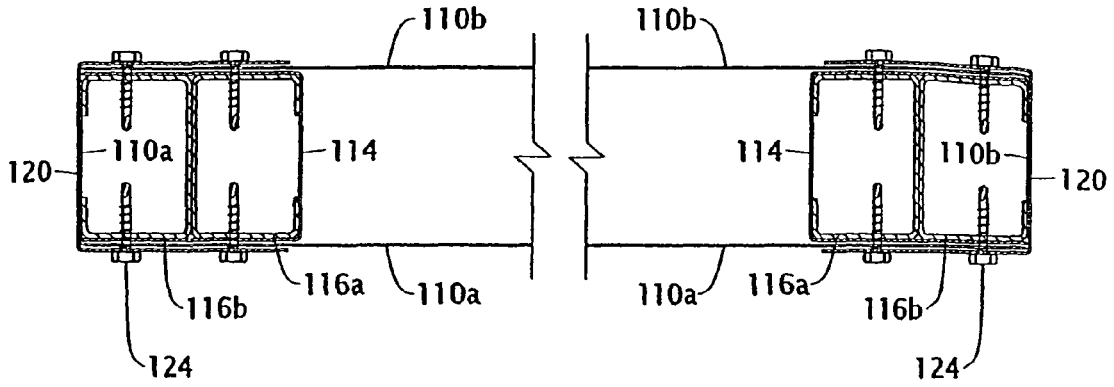
FIG. 3A is a sectional view of the shear panel shown in FIG. 1 taken along the line A-A, in FIG. 1.
Figure 3B:
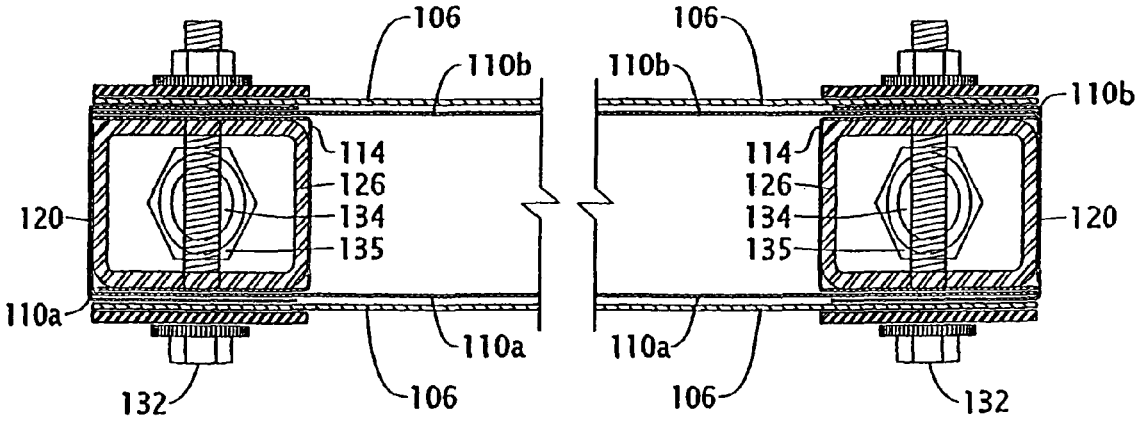
FIG. 3B is a sectional view of the shear panel shown in FIG. 1 taken along the line B-B, in FIG. 1.

As is also shown in FIGS. 2A and 3A, the two pieces of reinforcing Cee-channel 116*a* and 116*b* are positioned in the top portion of the inner retaining member 114. However, as shown in FIG. 3B, in the bottom portion of the inner retaining member 114, there is a piece of reinforcing tube 126 that is stronger than the reinforcing members 116*a* and 116*b*. In the preferred embodiment, the reinforcing tube 126 is comprised of 8-inch thick steel tubing that is approximately 6" long and 2"×3" in cross-section, which provides greater structural support for the bottom portion of the vertical posts 102*a* and 102*b* to minimize the tendency of the vertical posts 102*a* and 102*b* to bend in response to lateral forces applied to the upper portion of the shear panel 100. It will be appreciated that the Cee-channel reinforcing members can be replaced by the ⅛-inch thick steel tube along the full length of the inner retaining member 114 without departing from the spirit of the present invention.

In the preferred embodiment there are two diaphragm members 110*a* and 110*b* which are preferably comprised of sheet steel wherein each of the diaphragm members 110*a* and 110*b* have a lip 122 formed on a side of the diaphragm member 110. Preferably, as shown in FIG. 3A, the lip 122 has approximately the same width as the opening on the U-channel comprising the inner retaining member 114. In the preferred embodiment, the diaphragm members 110*a* and 110*b* are positioned immediately adjacent the inner retaining member 114 so that the lip 122 on one of the diaphragm members 110*a* and 110*b* is positioned in front of an opening 115 to the U-channel comprising the retaining member 114. An outer retaining member 120 is then positioned adjacent the diaphragm members 110*a* and 110*b*. In the preferred embodiment, the outer retaining member 120 is comprised of a length of U-channel member having an opening 121 that is slightly larger than the width of the inner retaining member 114 and the thickness of the two diaphragm members 110*a* and 110*b*.

Hence, the post 102*a* is comprised of an inner retaining member 114 that is reinforced by the reinforcing members 116 and the tube 126 positioned therein. The diaphragm members 110*a* and 110*b* are then positioned adjacent the inner retaining member 114 and captured within the outer retaining member 120.

As shown in FIGS. 1 and 3A, fasteners 124 are positioned along the entire height of the vertical posts 102*a* and 102*b* to securely interconnect the inner retaining member 114, the reinforcing members 116, the diaphragm members 110*a* and 110*b* and the outer retaining member 120. In the preferred embodiment, the fasteners 124 are comprised of screws wherein two screws are placed at approximately 4-inch intervals along the entire length of the vertical posts 102*a* and 102*b* between the upper member 104 and the lower member 106.

Figure 2B:
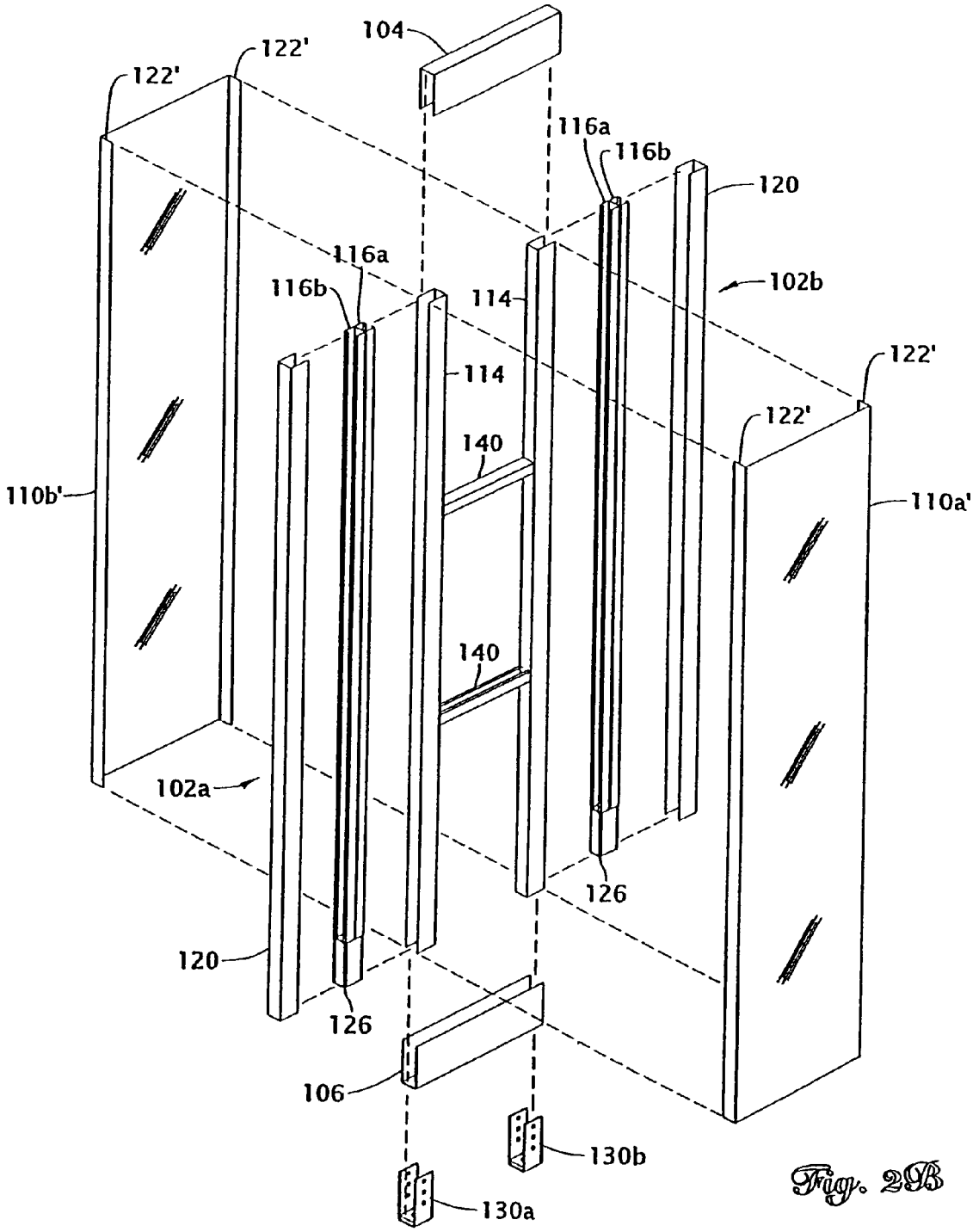
FIG. 2B is an exploded perspective assembly view of another embodiment of the shear panel shown in FIG. 1.
Figure 2C:
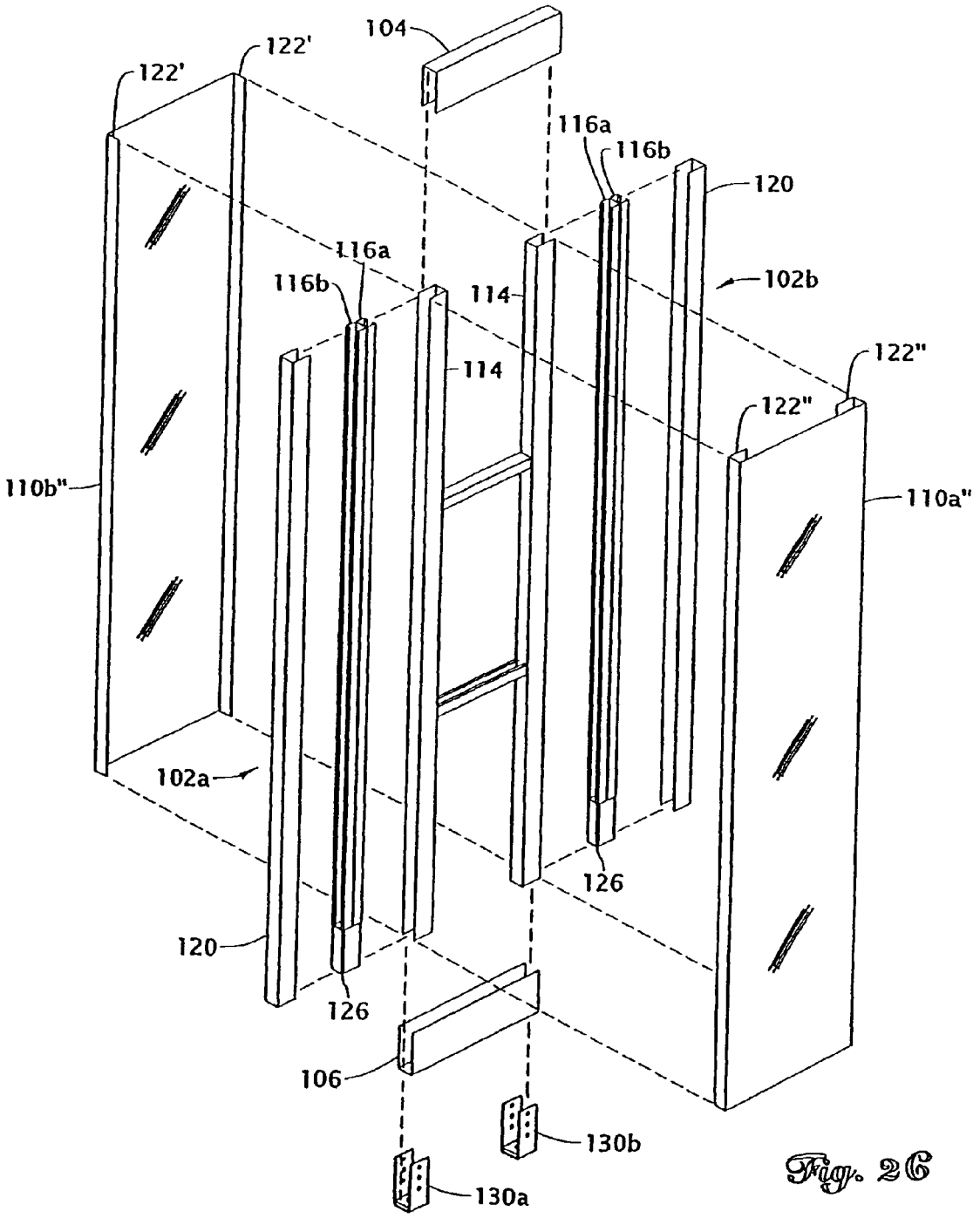
FIG. 2C is an exploded perspective assembly view of another embodiment of the shear panel shown in FIG. 1.

The foregoing description has described the preferred construction of the vertical post 102*a*, it will be appreciated that the vertical post 102*b* is constructed in an identical fashion as the vertical post 102*a*. FIGS. 2B and 2C illustrate alternate embodiments of the shear panel 100. In particular, FIG. 2B illustrates a diaphragm member 110*a*' and 110*b*' having lips 122' extending along both of the outer edges of the panels 110*a*' and 110*b*'. Similarly, FIG. 2C illustrates a diaphragm member 110*b*" having a lip 122', like the lip shown in FIG. 2B, may be used in combination with a diaphragm member 110*a*" that has a lip 122" which extends perpendicular to the plane of the member and then parallel to the plane of the member, thereby having a generally U-shaped cross-section may also be used to securely interconnect the diaphragm member to the vertical posts. It will be appreciated that any number of different methods of interconnecting the diaphragm members to the posts may be used without departing from the spirit of the present invention.

Figure 4A:
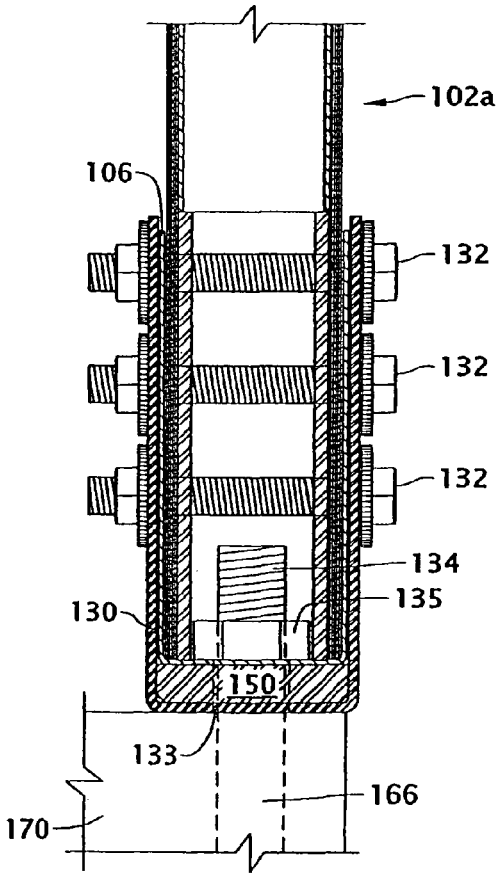
FIG. 4A is a sectional view of the shear panel of FIG. 1 taken along the lines D-D in FIG. 1.
Figure 4B:
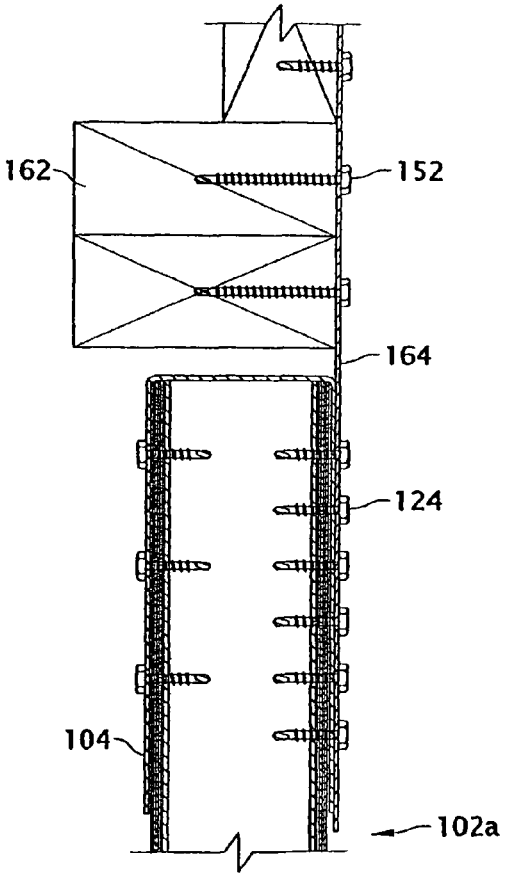
FIG. 4B is a sectional view of the shear panel of FIG. 1 taken along the lines C-C in FIG. 1.

As is also shown in FIG. 2A, the upper member 104 and the lower member 106 are comprised of a U-channel that has a width which is approximately equal to the width of the outer retaining member 120 of the vertical posts 102*a* and 102*b*. As is shown in FIGS. 2A and 4B, the upper member 104 has a U-shape cross-section with an opening 146 wherein the upper end 103*a* of the post 102*a* is positioned within the opening 146. A plurality of fasteners 124 are then used to interconnect the post 102*a* to the upper member 104. In the embodiment shown in FIG. 3B, the fasteners are comprised of screws. Further, the diaphragm members 110*a* and 110*b* are also positioned inside of the opening 146 of the upper member 104 and are attached, via screws, across the length of the upper member 104 in the manner shown in FIG. 1.

The lower member 106 is also comprised of a piece of U-channel that has an opening 148 that is substantially equal to the thickness of the outer retaining member 120 of the vertical post 102*a* and 102*b* to thereby allow the vertical posts 102*a* and 102*b* to be positioned within the lower member 106 and secured thereto. In the embodiment shown in FIGS. 1 and 2, there are two brackets 130*a* and 130*b* that have openings for bolts that are configured to fit around the outer walls of the lower member 106. As is shown in FIG. 1, the brackets 130*a* and 130*b* are mounted on the lower member 106 at the position where the vertical posts 102*a* and 102*b* are positioned within the lower member 106. A plurality of heavy duty fasteners 132, which in this embodiment are comprised of three bolts, are then screwed entirely through the brackets 130*a* and 130*b*, the lower member 106 and the vertical posts 102*a* and 102*b* to thereby securely attach the posts 102*a* and 102*b* to the brackets 130 and 130*b* respectively, in the manner shown in FIG. 4A.

As is also shown in FIG. 2A, there are two reinforcing members 140 that interconnect the vertical posts 102*a* and 102*b*. Specifically, the reinforcing members 140 are preferably comprised of pieces of U-channel which are connected to the inner retaining member 114 on each of the vertical posts 102*a* and 102*b*. Preferably the reinforcing members 140 are positioned approximately ⅓ of the way from the top and the bottom of the shear panel 100.

In one preferred embodiment of the shear panel of the present invention, the reinforcing members 116 are comprised of two pieces of Cee-channel that is 1½"×2" wide, 18 gauge and approximately 7'-2" or 9'-6" in length. The inner retaining member 114 is comprised of 2⅞"×2¼" U-channel that is 18 gauge and is 7'-8" or 10' long depending upon the embodiment of the shear panel that is being fabricated. The diaphragm members 110*a* and 110*b* are preferably comprised of a sheet of 18 gauge steel that is 7'-8" or 10' long depending upon the application and 2' wide wherein the sheet is bent along one edge to form a 2" lip. The outer retaining member 120 is preferably comprised of 18 gauge U-channel that is 3"×2" in cross-section and is either 7'-8" long or 10' long depending upon the application. The upper and bottom members 104 and 106 are comprised of 18 gauge U-track that is 5 13/16"×2⅜" in cross-section and is 1'-10" in length. The brackets 130*a* and 130*b* are preferably comprised of ⅛" thick steel that is 6½" in height, 2 9/16" in width and 3" long. Further, along the side walls of the bracket there are three ½" holes drilled on both of the side walls. Further, there is a 2 9/16"×3"×½" thick plate 150 welded to the bottom of the bracket with a 1" hole in the center and ⅛" chamfers along the lower 3" edges.

Figure 5:
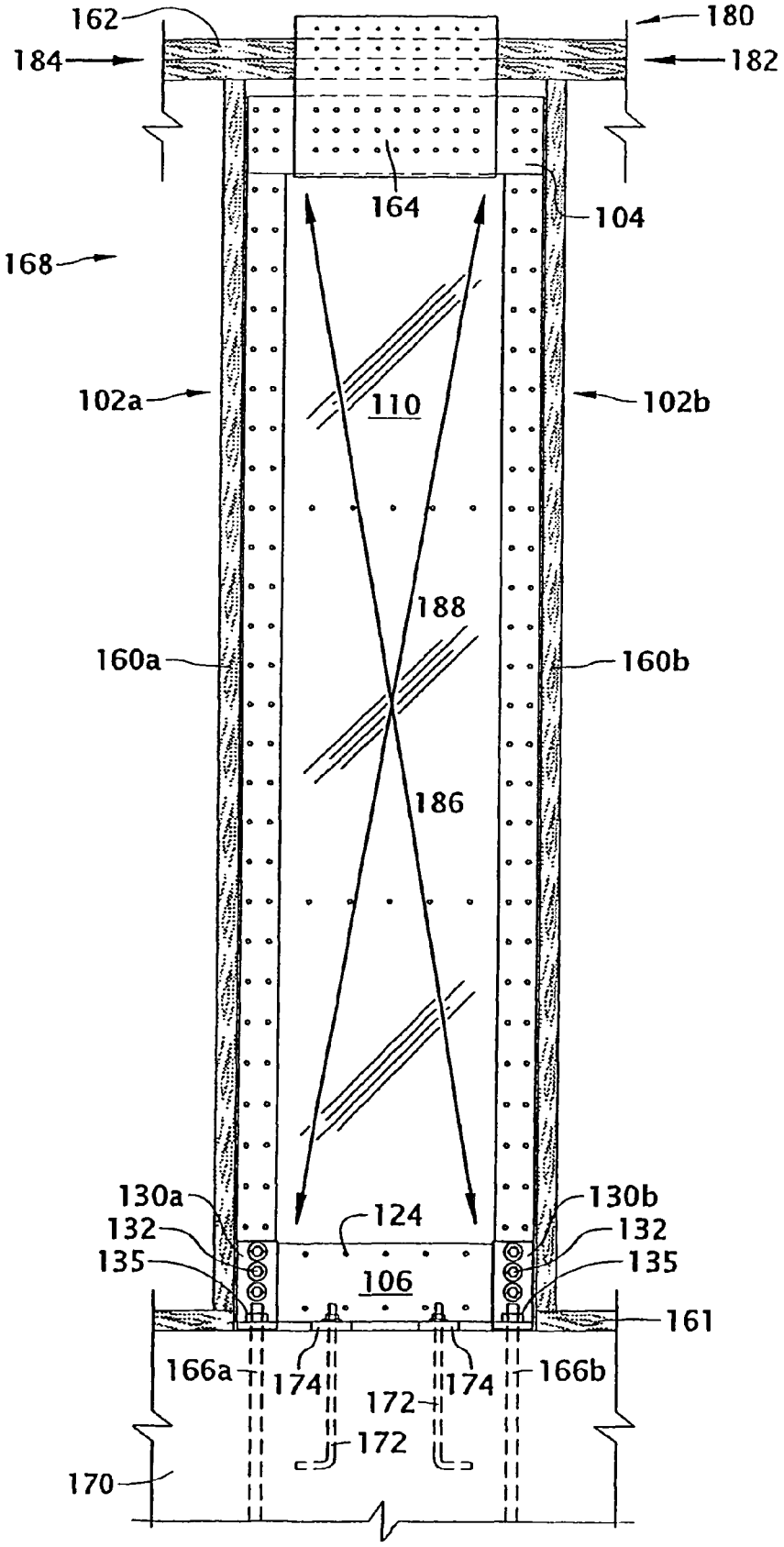
FIG. 5 is an elevation view of the shear panel of FIG. 1 installed in a one-story wall of a building having wooden framing.

The installation and operation of the sheer panel 100 will now be described in reference to FIGS. 5-7. FIG. 5 illustrates how the shear panel 100 is installed in a single story wall 168 of a building. In particular, the shear panel 100 is installed so as to extend between two of the vertical studs 160*a* and 160*b* of the wall. While in the preferred embodiment the shear panel is not directly attached to these studs 160*a* and 160*b* but is inset inside of them, it will be understood, however, that the shear panel 100 may, in some circumstances, be attached to the studs 160*a* and 160*b* using suitable fasteners to further enhance the ability of the wall to withstand shear forces.

The shear panel 100 is connected to an upper plate 162 of the wall structure, which in this embodiment is comprised of two 2"×4" boards, via a gusset 164 in the manner shown in FIGS. 4B and 5. The gusset 164 is connected both to the upper plate 162 and to the upper member 104 of the shear panel 100 through the use of nails, screws, or other fasteners. In the preferred embodiment, a multiplicity of wood screws 152 (FIG. 4B) is used to securely fasten the gusset 164 to the upper plate and a plurality of fasteners 124 is used to connect the gusset 164 to the upper member 104 of the shear panel 100.

At the lower end of the shear panel 100, the brackets 130*a* and 130*b* comprise an anchor point or attachment point that are mounted over two holdown bolts 166*a* and 166*b* that are anchored in the foundation 170 of the building. The holdown bolts 166 can either be previously anchored into the foundation 170 or they can be retrofitted into the foundation in the desired location using well-known methods. Generally, the holdown bolts 166 stub up through the upper surface of the foundation 170 and the brackets 130*a* and 130*b* can be positioned over the holdown bolts with the bolts extending through an opening 133 (FIG. 4) in the bottom of the bracket 130*a* and 130*b*. The brackets 130 and 130 *b* can then be securely fastened to the holdown bolts 166 by tightening a nut 135 (FIG. 41) on top of the bolts against the reinforcing plate 150 on the bottom surface of the brackets 130*a* and 130*b*.

Subsequently, the lower member 106 can then be installed in the bracket and the vertical posts 102*a* and 102*b* can then be positioned within the lower member 106 at a position adjacent the brackets 130*a* and 130*b* so that the bolts 132 can be installed through the brackets 130*a* and 130*b*, the lower member 106 and the posts 102*a* and 102*b* to secure the posts 102*a* and 102*b* to the brackets 130*a* and 130*b* and thereby anchor the vertical posts 102*a* and 102*b* and the diaphragm members 110*a* and 110*b* forming the panel 100 to the foundation.

It will also be appreciated that it may be desirable to attach the shear panel 100 to one or more shear bolts 172 that are previously mounted in the foundation 170. The shear bolts 172 stub up out of the foundation 170 and holes can be drilled in the lower member 106 so that the lower member 106 can be positioned over the shear bolts 172 and then attached to the shear bolts via nuts. Further, it will be appreciated that spacers 174 (FIG. 5) may preferably be positioned between the foundation 170 and the bottom surface of the lower member 106 in order to ensure that there is adequate attachment between the lower member 106 and the shear bolts 172 mounted in the foundation 170. As is also shown in FIG. 5, the bottom plate 161 between the studs 160*a* and 160*b* is preferably removed prior to installation of the shear panel 100.

From the foregoing description, it will be understood that the shear panel 100 of the preferred embodiment is easy to install in the wall of a building. Specifically, the builder of the wall simply has to ensure that the holdown bolts 106 and the shear bolts 172 are positioned so as to be substantially coplanar with one of the two outer edges of the upper plate 162 of the frame. Subsequently, the brackets 130*a* and 130*b* can then be mounted on the holdown bolts in the previously described fashion and the lower member 106 can be connected to the shear bolts and positioned within the brackets 130*a* and 130*b*.

Subsequently, the remainder of the shear panel 100 can be installed in the lower member 106 and the bolts 132 can be installed to connect the vertical post 102*a* and 102*b* to the lower member 106 and the brackets 130*a* and 130*b*. Further, screws 124 along the lower member 106 can then be installed to interconnect the lower member 106 to the diaphragm members 110*a* and 110*b*. Once the shear panel 100 is connected to the foundation, the gusset 164 can then be connected to the upper member 104 and the upper plate of the wall. In the preferred embodiment, the shear panel 100 will preferably be shipped to the job site in substantially the configuration shown in FIG. 1 and the workers will then detach the brackets 130*a* and 130*b* and the lower member 106 for installation to the foundation in the previously described manner.

It will be appreciated that installation of the shear panel 100 on the wall 168 reduces the tendency of the upper portion 180 of the wall 168 to move with respect to the foundation 170. Specifically, the arrows 182 and 184 are representative of lateral forces that are directed parallel to the length of the wall 168. It will be appreciated that when a lateral force in the direction of the arrow 182 is applied to the wall 168 the upper portion 180 of the wall 168 will have a tendency to pivot about the left-most holdown bolt 166*a*. However, the force in the direction of the arrow 182 is opposed by an equal and opposite force exerted on the right bottom corner of the shear panel 100 by the holdown bolt 166*b* thereby reducing the tendency of the shear panel to overturn. The shear bolts 172 prevent the panel and wall 168 from sliding in the direction of the arrow 182.

Basically, the gusset 164, the upper member 104, the diaphragm members 110*a* and 110*b* and the posts 102*a* and 102*b* provide a diagonally braced frame in each direction of the arrow 186 in FIG. 5 which reduces the tendency of the upper portion 180 of the wall to move in the direction of the arrow 182. Similarly, when a shear force is directed parallel to the length of the wall 168 in the direction of the arrow 184, the gusset 164, the upper member 104, the diaphragm members 110*a* and 110*b* and the posts 102*a* and 102*b* serve as a diagonal brace in the direction of the arrow 188 with the left-most holdown bolt 166*a* to oppose the tendency of the shear panel to overturn and the wall 180 to move in the direction of the arrow 184.

Hence, the shear panel 100 opposes the movement of the wall in directions which are parallel to the length of the wall and in the plane of the wall and, based upon pseudo-cyclic testing performed at the University of California, Irvine, in Irvine, Calif., a shear panel having the configuration of the preferred embodiment of the shear panel 100 is capable of withstanding up to 3500 lbs. of load applied to the upper portion 180 of a 7'-8" wall structure 168 while only having the upper portion of the wall deflect approximately ½" or less from its normal resting position.

Essentially, the shear panel 100 preferably functions like a large vertical cantilevered girder fixed at the bottom and loaded horizontally in the plane of the panel at the top member. The diaphragm members 110*a* and 110*b* resist the shear forces and the flanges of the girders are comprised of the post assemblies 102*a* and 102*b* which resist the axial stress due to bending. Preferably, the brackets 130*a* and 130*b* and the holdown bolts 166 are sized to withstand the uplift force generated by the overturning moment of the panel 100 when exposed to forces in the direction of the arrows 182 and 184, i.e., horizontal forces, and the shear bolts 172 are sized to resist the horizontal shear force. The reinforcing members 140 serve the purpose of reducing the tendency of the diaphragm members 110*a* and 110*b* to buckle under the loads generated by the shear forces. It will be appreciated that the shear panel 100 of the preferred embodiment is thus very easy to install and is capable of withstanding significantly more shear forces than the shear panels that are currently used in residential and business construction.

Figure 6:
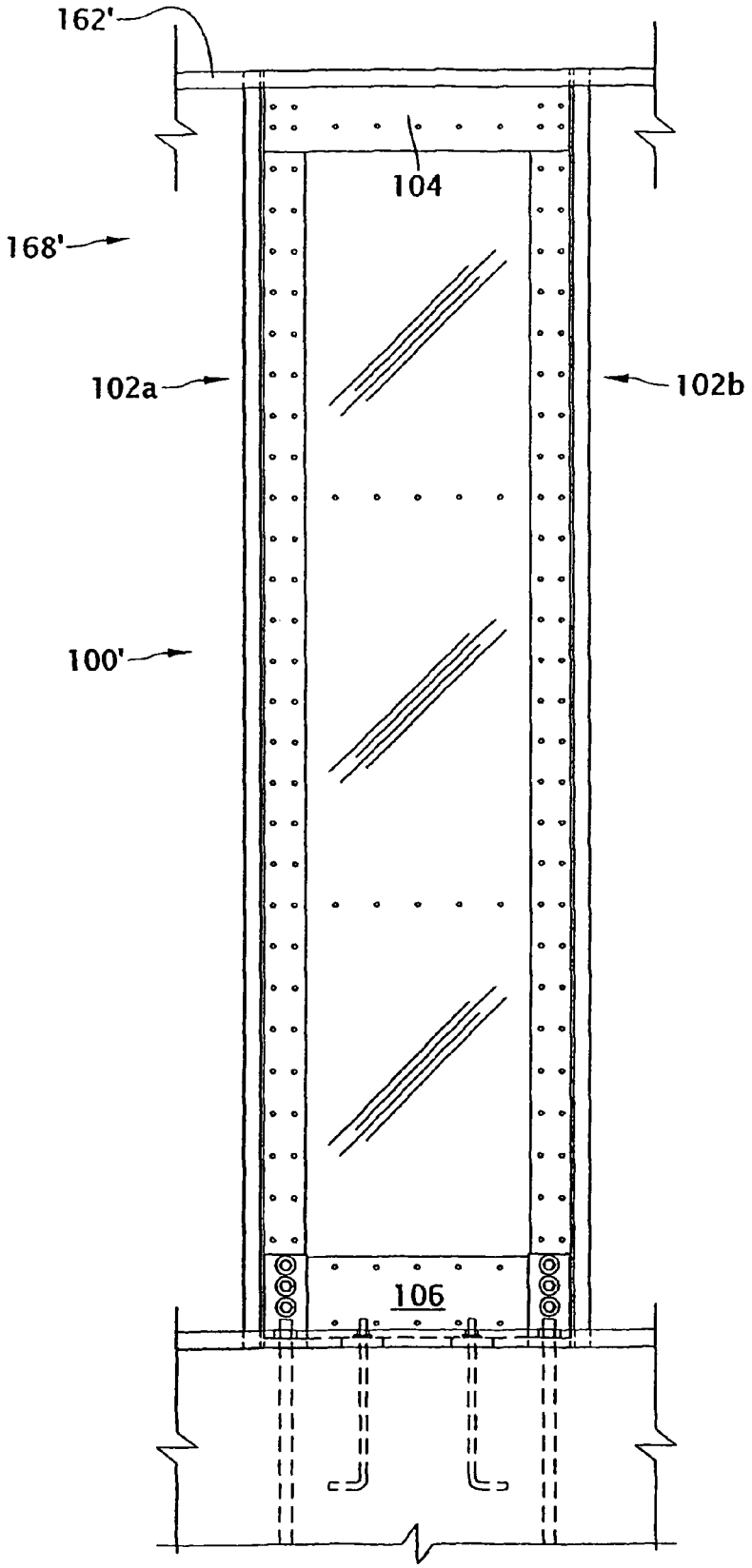
FIG. 6 is an elevation view of the shear panel of FIG. 1 that is modified so as to be installed in a one-story wall having steel framing.

FIG. 6 illustrates a modified version of the embodiment of the shear panel 100' wherein the shear panel 100' is configured to be installed in a steel framed wall 168'. It will be understood that both wood framed walls and steel framed walls are currently used in standard construction techniques and that the shear panels 100 and 100' can be used equally well with either type of construction. The only difference in the shear panel 100' from the shear panel 100 is that the dimensions of the shear panel may change as a result of the differences in framing spaces in the steel frame wall 168 and that the upper member 104 of the shear panel 100' can be bolted or screwed directly to a steel upper plate or track 162' of the wall 168' thereby avoiding the need of a gusset. Hence, it will be appreciated that the shear panel of the present invention can be installed equally well on both wood framed and steel framed walls and that the exact dimensions and configuration of the shear panel will, of course, vary depending upon the spacing of the studs in the wall and the height of the wall.

Figure 7:
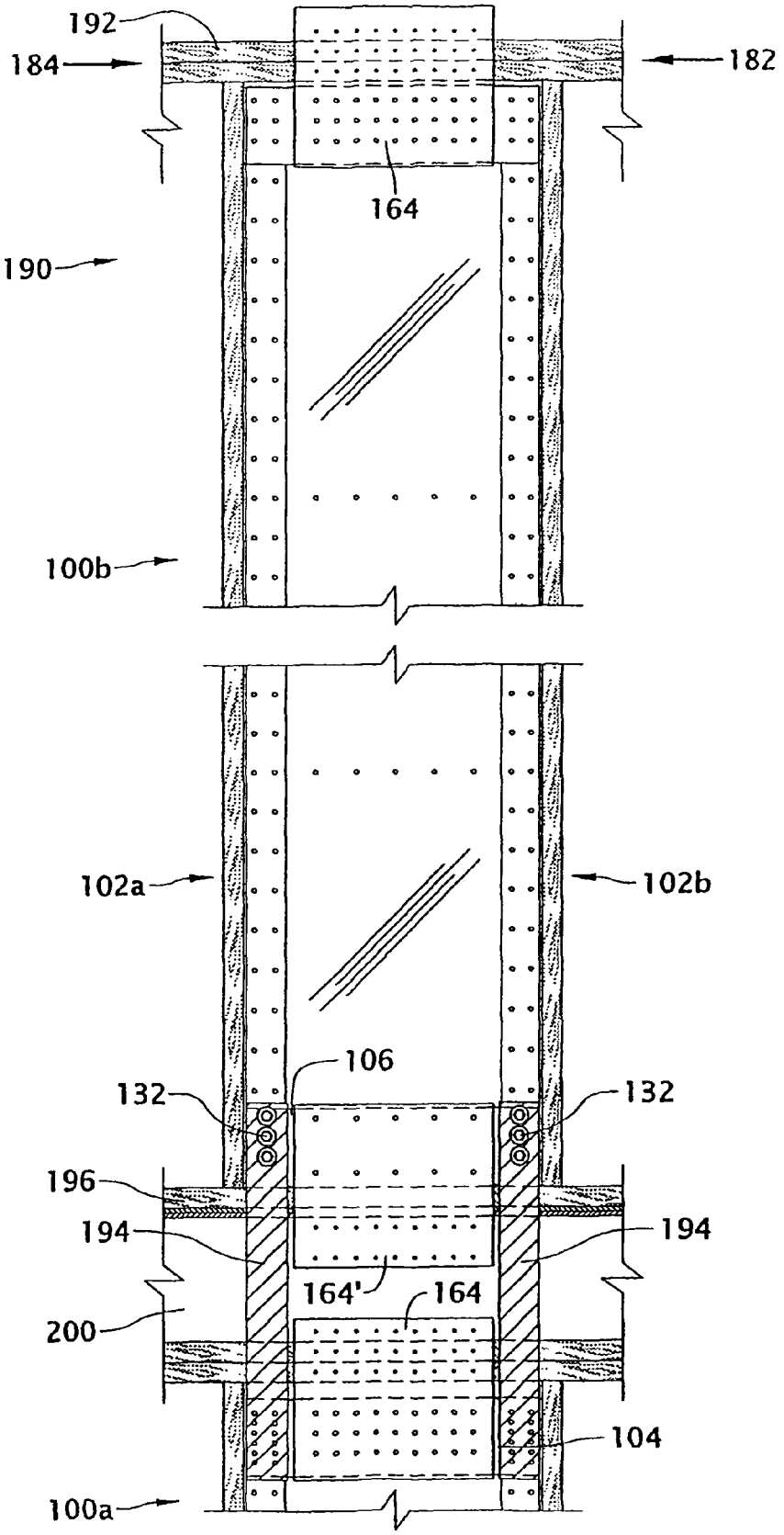
FIG. 7 is a partial elevation view of two shear panels of FIG. 1 installed on a two-story building.

FIG. 7 illustrates how two shear panels 100 of the preferred embodiment can be used to provide shear protection for two-story walls. In particular, two shear panels 100 are installed in the two-story wall 190 with the lower shear panel 100*a* being installed in the exact same manner as described before with reference to FIG. 5. The upper shear panel is attached to an upper plate 192 of the two-story wall 190 with a gusset 164 in the same manner as described before in reference to FIG. 5. At the bottom end, the vertical posts 102*a* and 102*b* and the lower member 106 are not positioned within brackets 130*a* and 130*b* but, in fact, are attached to metal straps 194 via the bolts 132 that are then connected to the upper member 106 of the lower shear panel 100. The bolts 132 are preferably connected to the posts 102*a* and 102*b* of the upper panel 100*b* in the same manner as described above in reference to FIG. 4A.

Further, a gusset 164' can also be used to attach the lower member 106 of the upper shear panel 100 to a floor space member 200 of the two-story wall 190. The straps 194 firmly connect the bottom portion of the upper shear panel 100*b* to the top portion of the bottom shear panel 100*a* so that the upper panel 100*b* is anchored to the lower panel 100*a* across the floor space member 200 between the two stories of the wall.

Further, the lower gusset 164' further reduces the tendency of the upper portion of the second story of the wall 190 to move with respect to the lower plate 196 of the second story of the wall as the shear panel is connected along its entire width to the floor space member 200 of the second story of the wall via the lower gusset 162*b*. Since the lower shear panel 100*a* is attached to the foundation in the manner described above in reference to FIG. 5 and since the upper panel 100*b* is attached to the lower panel 100*a* via the straps 194, movement of the upper portion 190 of the second story of the wall 190 as a result of lateral forces being applied in a direction parallel to the wall, i.e., in the direction of the arrows 182 and 184, is reduced.

It will be appreciated that the previously described preferred embodiments of the shear panels are easy to install as a result of their prefabrication and provide excellent protection against shear forces that are acting in a direction parallel to the length of the wall. Specifically, the shear panel of the present invention uses two reinforced posts with an interconnecting diaphragm member to transfer the forces, resulting from a shear force being applied against the wall, to the holdown bolts that are embedded in the foundation. Since the panel is largely pre-fabricated, the worker simply has to connect the panel to the upper plate of the wall and then connect the lower portion of the panel to the holdown and shear bolts mounted in the foundation. Hence, it is simpler for the construction worker to install the shear panel and, since the panel is pre-fabricated, the possibility of field installation error, which would increase the probability that the panel would not perform as intended, is of course reduced.

Further, since reinforced posts are used in conjunction with metal diaphragm sheets, the amount of shear force that can be transferred to the holdown bolts is increased. Specifically, using the shear panel constructed in the manner as the shear panels of the preferred embodiment, a shear panel that is only two feet in width can be used in the place of a shear panel structure fabricated out of plywood and the like that is over four feet in length. Hence, shear panels constructed according to the teachings of the preferred embodiment, e.g., with reinforced metal posts and with metal diaphragm members, can be used to provide protection against movement of the upper portions of walls relative to the foundations for walls that are short in length.

Although the preferred embodiment of the present invention has shown, described and pointed out the fundamental novel features of the invention as applied to these embodiments, it will be understood that various omissions, substitutions, and changes in the form of the detail of the device illustrated, may be made by those skilled in the art without departing from the spirit of the present invention. Consequently, the scope of the invention should not be limited to the foregoing discussion, but is to be defined by the appended claims.

What is claimed is:

1. A pre-assembled apparatus for reducing the tendency of upper proportions of a wall to move with respect to a foundation as a result of lateral forces applied in a direction parallel to the wall, said apparatus in combination with said wall comprising:

said wall, said wall having and upper plate, a lower plate, and studs connecting said upper plate to said lower plate, said studs supporting said upper plate;

said apparatus inserted within and connected to said wall, said apparatus comprising two vertically extending posts having both an upper and a lower end and defining a front and a back side, wherein said two vertically extending posts are positioned in a pre-selected spaced relationship;

a horizontally extending upper member which is connected to said upper ends of said two vertically extending posts and wherein said horizontally extending upper member is connected to an upper portion of said wall;

one or more brace members that interconnect said two vertically extending posts so as to maintain said vertically extending posts in said pre-selected spaced relationship when said apparatus is installed in a wall that is under shear stress from said lateral forces; and two attachment points which are respectively connected to said two vertically extending posts wherein said both of said two attachment points are attached to anchor points that are in structural connection with said foundation of said building to thereby anchor said vertically extending posts to said anchor points, and wherein said apparatus is pre-assembled to allow for installation in said wall by attaching said two attachment points to said anchor points and connecting said upper member to said upper portion of said wall so that said apparatus thereby reduces the tendency of said upper portion to move relative said foundation.

2. The apparatus of claim 1, wherein said one or more brace members is comprised of one or more planar members attached to said two vertical posts.

3. The apparatus of claim 2, further comprising a lower horizontal member that is attached to said lower ends of said two vertical posts.

4. The apparatus of claim 3, wherein said apparatus reduces the tendency of an upper portion of said wall to move relative said foundation with respect to an uplift force, said uplift force on said wall occurring as a result of an overturn movement caused by said wall being exposed to said lateral forces.

5. The apparatus of claim 4, wherein said two vertical posts and said planar members are formed out of metal.

6. The apparatus of claim 5, wherein said two vertical posts are approximately 7'-8" in height and said apparatus is less than 3 feet in width and said apparatus is adapted to reduce the tendency of said upper portion of said wall to move when said upper horizontal member of said apparatus is connected to said upper portion of said wall, said upper portion of said wall being formed with an upper plate, and when said lateral forces cause said upper plate to move, causing motion, said apparatus reduces said motion of said upper plate of said wall that is connected to said upper horizontal member to approximately 0.5" of deflection or less from a rest position when subjected to 3,500 lb. of said lateral forces applied on said upper plate in said direction parallel to said horizontal upper member in a pseudo-cyclic shear testing.

7. An apparatus for reducing the tendency of an upper portions of a wall in a building to move with respect to a foundation as a result of lateral forces applied in a direction parallel to the wall, said apparatus in combination with said wall comprising:

said wall, said wall having and upper plate, a lower plate, and studs connecting said upper plate to said lower plate, said studs supporting said upper plate;

said apparatus inserted within and connected to said wall, said apparatus comprising two vertically extending posts having both an upper end and a lower end and defining a front and back side, wherein said two vertically extending posts are positioned in a preselected spaced relationship;

at least one panel member interconnecting said two vertically extending posts substantially along the entire length of said posts;

two holdown bolts that are anchored in said foundation of said building; and two attachment points which are respectively connected to said lower ends of said vertically extending posts wherein said both of said two attachments points are respectively in connection with said two holdown bolts, and wherein said apparatus is connected to said wall by said two attachment points in connection with said holdown bolts and said upper end of said vertical posts attached to said upper portions of said wall so that said apparatus thereby reduces the tendency of said upper portions of said wall to move relative said foundation as a result of shear stress by transmitting said shear stress from said upper portions of said wall through said vertical members and said at least one panel member to said anchor points and said holdown bolts positioned in said foundation, and wherein said posts and said panel of said apparatus for reducing the tendency of said wall to move are separate members from said studs, said upper plate and said lower plate of said wall.

8. The apparatus of claim 7, further comprising;

an upper horizontal member that interconnects said upper portions of said two vertical posts, wherein connection between said upper portions of said vertical posts is achieved by connecting said upper horizontal member to said upper portions of said vertical posts; and a lower horizontal member that interconnects said lower portions of said two vertical posts, and wherein said upper horizontal and said lower horizontal members are separate members from said upper plate and said lower plate of said wall.

9. The apparatus of claim 7, further comprising shear bolts mounted in said foundation and wherein said lower horizontal member is attached to said shear bolts mounted in said foundation to thereby reduce the likelihood of a lower portion of said apparatus becoming dislodged from said foundation in response to lateral forces applied to said wall.

10. The apparatus of claim 7, wherein said panel of the apparatus is not directly connected to any of the studs, the upper plate or the lower plate of said wall.

11. The apparatus of claim 7, wherein said apparatus connects to said upper plate of said wall.

12. The apparatus of claim 8, wherein said panel does not extend beyond said upper horizontal member of said apparatus.

13. A method of building a wall so that the tendency of an upper portion of a wall having an upper plate to move relative a lower portion of said wall is reduced when said wall is submitted to a lateral force, said method comprising the steps of:

providing a foundation for said wall, wherein one or more holdown bolts are each installed in said foundation at a pre-selected location in said foundation;

mounting two or more studs so as to extend substantially vertically upward from said foundation;

positioning an upper plate on a top surface of said two or more studs;

making a structural connection of a sheer reduction panel to said holdown bolts and positioning said shear reduction panel so that said panel is positioned between said two studs, said shear reduction panel being pre-assembled to have two vertical posts, an upper horizontal member and a lower horizontal member connecting said two vertical posts, and one or more brace members that interconnect said two vertically extending posts so as to maintain said vertically extending posts in said pre-selected spaced relationship when said apparatus is installed in a wall that is under shear stress from said lateral forces; and attaching an upper portion of said shear reduction panel to said upper plate of said wall so that movement of said upper plate of said wall in response to lateral forces applied to said upper plate of said wall in response to lateral forces applied to said wall is reduced as a result of the lateral forces being transmitted through the vertical posts and the interconnecting panel to the holdown bolts mounted in the foundation.

14. The apparatus of claim 13, wherein said one or more brace members is comprised of one or more planar members attached to said two vertical posts.

15. The method of claim 13, wherein said the brace member does not extend beyond said upper horizontal member of said apparatus.

* * * * *